US012102168B2

(12) United States Patent
Lussier et al.

(10) Patent No.: US 12,102,168 B2
(45) Date of Patent: Oct. 1, 2024

(54) ARTICLE OF FOOTWEAR WITH RIBBED OUTSOLE AND NOTCHED MIDSOLE

(71) Applicant: adidas AG, Herzogenaurach (DE)

(72) Inventors: Michel Reginald Lussier, Portland, OR (US); Matteo Edmond Padovani, Portland, OR (US); George Alan Robusti, Portland, OR (US); Alexander Mark Brill, Portland, OR (US); Christopher Nelson Padilla, Portland, OR (US)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 18/165,070

(22) Filed: Feb. 6, 2023

(65) Prior Publication Data

US 2023/0180885 A1 Jun. 15, 2023

Related U.S. Application Data

(63) Continuation of application No. 16/237,459, filed on Dec. 31, 2018, now Pat. No. 11,583,029, which is a continuation-in-part of application No. 15/877,083, filed on Jan. 22, 2018, now Pat. No. 10,986,896.

(51) Int. Cl.

| | |
|---|---|
| ***A43B 13/12*** | (2006.01) |
| ***A43B 13/14*** | (2006.01) |
| ***A43B 13/16*** | (2006.01) |
| ***A43B 13/28*** | (2006.01) |

(52) U.S. Cl.

CPC ..... *A43B 13/122* (2013.01); *A43B 13/12* (2013.01); *A43B 13/125* (2013.01); *A43B 13/14* (2013.01); *A43B 13/16* (2013.01); *A43B 13/28* (2013.01)

(58) Field of Classification Search

CPC ..... A43B 13/145; A43B 13/122; A43B 13/38; A43B 7/144; A43B 7/1425; A43B 3/0047; A43C 15/161; A43C 15/16; A43C 15/02; A43C 15/18

See application file for complete search history.

(56) References Cited

U.S. PATENT DOCUMENTS

| | | | | | |
|---|---|---|---|---|---|
| 2,333,201 | A * | 11/1943 | Russell | A43B 13/12 36/DIG. 2 |
| 2,366,039 | A * | 12/1944 | Mackensen | A43B 13/00 36/22 R |
| 3,426,455 | A | 2/1969 | Drago | |
| 4,075,772 | A * | 2/1978 | Sicurella | A43B 7/146 36/43 |

(Continued)

FOREIGN PATENT DOCUMENTS

| | | | |
|---|---|---|---|
| CN | 101351131 | A | 1/2009 |
| CN | 201691172 | U | 1/2011 |

(Continued)

OTHER PUBLICATIONS

"region" Collins. Web. https://www.collinsdictionary.com/us/dictionary/english/region.

*Primary Examiner* — Jillian K Pierorazio

(74) *Attorney, Agent, or Firm* — Sterne, Kessler, Goldstein & Fox P.L.L.C.

(57) ABSTRACT

A sole for an article of footwear includes an outsole that has longitudinal ribs and a midsole that is disposed above the outsole and that defines notches. The longitudinal ribs are disposed in the notches.

16 Claims, 16 Drawing Sheets

(56) References Cited

U.S. PATENT DOCUMENTS 4,130,947 A * 12/1978 Denu ..... A43B 13/223 36/32 R
4,267,650 A * 5/1981 Bauer ..... A43B 3/24 36/15
4,561,197 A * 12/1985 Misevich ..... A43C 15/161 36/134
4,676,010 A 6/1987 Cheskin
4,685,224 A 8/1987 Anger
4,779,361 A 10/1988 Kinsaul
5,255,451 A * 10/1993 Tong ..... A43B 13/181 36/28
5,375,346 A 12/1994 Cole et al.
5,595,004 A 1/1997 Lyden et al.
5,657,556 A * 8/1997 Bemis ..... A43C 15/161 12/142 P
6,082,023 A * 7/2000 Dalton ..... A43B 13/187 36/31
6,092,307 A * 7/2000 Singer ..... A43B 9/00 36/31
6,098,313 A * 8/2000 Skaja ..... A43B 13/181 36/35 R
6,327,795 B1 * 12/2001 Russell ..... A43B 13/12 36/27
6,675,502 B1 * 1/2004 Chen ..... A43B 13/187 36/28
7,082,702 B2 8/2006 Cretinon
7,178,271 B2 * 2/2007 Covatch ..... A43B 13/141 36/102
7,290,357 B2 * 11/2007 McDonald ..... A43B 3/0057 36/102
7,337,559 B2 * 3/2008 Russell ..... A43B 13/12 36/3 R
7,398,608 B2 7/2008 Schoenborn
7,574,817 B2 8/2009 Fechter
7,594,345 B2 9/2009 Fusco
7,832,117 B2 * 11/2010 Auger ..... B29D 35/142 36/103
7,946,058 B2 5/2011 Johnson et al.
7,966,751 B2 6/2011 Durand
8,567,097 B2 10/2013 Edy et al.
8,745,897 B2 * 6/2014 Wojnar ..... A43C 15/02 36/67 B
9,271,541 B2 3/2016 Biancucci et al.
9,289,028 B1 3/2016 Anderson
9,451,806 B2 * 9/2016 Baker ..... A43B 7/144
9,504,293 B2 * 11/2016 Tsang ..... A43B 13/184
9,578,922 B2 * 2/2017 Abshire ..... A43B 21/26
9,833,038 B2 * 12/2017 Foxen ..... A43B 13/181
10,986,896 B2 4/2021 Lussier et al.
2001/0007177 A1 7/2001 Brown, Jr. et al.
2002/0017036 A1 2/2002 Berger et al.
2002/0089805 A1 * 7/2002 Maritz ..... A43B 13/12 361/224
2005/0005474 A1 * 1/2005 Lai ..... A43B 5/02 36/31
2005/0055845 A1 3/2005 Hay
2005/0138838 A1 * 6/2005 Lin ..... A43B 7/125 36/3 B
2005/0223594 A1 * 10/2005 Issler ..... A43B 7/08 36/3 R
2005/0268490 A1 * 12/2005 Foxen ..... A43B 13/189 36/28
2006/0021259 A1 * 2/2006 Wood ..... A43C 15/167 36/134
2006/0021260 A1 * 2/2006 Kim ..... A43B 21/39 36/130
2006/0254093 A1 11/2006 Fuchslocher et al.
2007/0113426 A1 * 5/2007 Abadjian ..... A43B 13/125 36/102
2007/0220778 A1 9/2007 Fusco et al.
2007/0240333 A1 * 10/2007 Le ..... A43B 17/10 36/103
2007/0277401 A1 * 12/2007 Young-Chul ..... A43B 13/186 36/28
2008/0222920 A1 * 9/2008 Rovida ..... A43B 3/0047 36/62
2008/0229617 A1 9/2008 Johnson et al.
2008/0271341 A1 * 11/2008 Amark ..... A43C 15/14 36/61
2008/0289215 A1 * 11/2008 Park ..... A43B 13/145 36/28
2009/0151196 A1 * 6/2009 Schindler ..... A43B 13/20 36/35 B
2011/0119962 A1 * 5/2011 Gerber ..... A43B 13/36 12/142 P
2011/0252664 A1 * 10/2011 Jennings ..... A43B 17/02 36/28
2011/0302805 A1 12/2011 Vito
2012/0000095 A1 1/2012 Torrance
2012/0233885 A1 * 9/2012 Shaffer ..... A43B 13/20 36/83
2012/0297644 A1 * 11/2012 Polegato Moretti ..... A43B 7/08 36/103
2013/0000151 A1 1/2013 Campbell et al.
2013/0031804 A1 2/2013 Abshire
2013/0059116 A1 * 3/2013 Peikert ..... A43B 13/026 36/25 R
2013/0081304 A1 * 4/2013 Abshire ..... A43B 13/181 36/28
2013/0104419 A1 * 5/2013 Horesh ..... A43B 7/141 36/43
2013/0185955 A1 7/2013 Cheng
2013/0219755 A1 8/2013 Polegato Moretti
2013/0232821 A1 * 9/2013 Schindler ..... A43B 13/181 36/103
2013/0318828 A1 12/2013 Sink
2014/0075778 A1 * 3/2014 Bruce ..... A43B 13/10 36/29
2014/0075779 A1 3/2014 Bruce et al.
2014/0223777 A1 8/2014 Whiteman et al.
2015/0082668 A1 * 3/2015 Nonogawa ..... A43B 7/144 36/30 R
2015/0128455 A1 * 5/2015 Lubart ..... A43C 15/00 36/25 R
2015/0245685 A1 * 9/2015 Cross ..... A43B 13/187 12/146 B
2015/0273778 A1 * 10/2015 Campos, II ..... B29C 51/12 12/142 T
2016/0021972 A1 * 1/2016 Grelle ..... A43B 7/24 36/140
2016/0174659 A1 * 6/2016 Lubart ..... A43B 13/223 36/59 C
2016/0192739 A1 * 7/2016 Hoffer ..... A43B 7/146 36/28
2016/0324264 A1 * 11/2016 Johnson ..... A43B 3/244
2016/0353839 A1 12/2016 Yamamoto
2017/0027282 A1 2/2017 Santos et al.
2017/0035143 A1 * 2/2017 Sato ..... A43B 7/148
2017/0156439 A1 * 6/2017 Yoshida ..... A43B 23/027
2017/0202306 A1 * 7/2017 Do ..... A43B 13/20
2017/0303631 A1 * 10/2017 Johnson ..... A43B 3/246
2017/0340058 A1 * 11/2017 Madore ..... A43B 13/223
2019/0223548 A1 7/2019 Lussier et al.
2019/0223553 A1 7/2019 Lussier et al.
2019/0281929 A1 * 9/2019 Malo ..... A43B 13/146

FOREIGN PATENT DOCUMENTS

CN 203841199 U 9/2014
CN 205321402 U 6/2016
CN 105831875 A 8/2016
CN 106604657 A 4/2017
DE 10 2011 008 664 A1 6/2011
FR 3 008 587 A1 1/2015
FR 3 036 927 A1 12/2016
GB 2 351 005 B 10/2002
JP 3613515 B2 11/2004
JP 4286070 B2 4/2009
JP 4745401 B2 5/2011

(56) References Cited

FOREIGN PATENT DOCUMENTS

| | | | |
|---|---|---|---|
| JP | 2014-151210 | A | 8/2014 |
| JP | 2017-029668 | A | 2/2017 |
| JP | 2017-35170 | A | 2/2017 |
| WO | WO 2006/031005 | A1 | 3/2006 |
| WO | WO 2007/074978 | A1 | 7/2007 |
| WO | WO 2010/003467 | A1 | 1/2010 |

* cited by examiner

ARTICLE OF FOOTWEAR WITH RIBBED OUTSOLE AND NOTCHED MIDSOLE

CROSS-REFERENCE TO RELATED APPLICATION

This application is a continuation of U.S. patent application Ser. No. 16/237,459, filed Dec. 31, 2018, which is a continuation-in-part of U.S. patent application Ser. No. 15/877,083, filed Jan. 22, 2018, the disclosures of which are incorporated herein in their entirety by reference thereto.

BACKGROUND

Field

Embodiments of the present invention relate generally to articles of footwear; and more specifically, to articles of footwear with a ribbed outsole and a notched midsole.

Background

Articles of footwear are used to enhance the wearer's walking and/or running experience. For example, a sole may provide cushioning, support, and stability that enhance the heel-to-toe transition of the gait cycle. Improvements to soles and articles of footwear that provide the desired characteristics to enhance the wearer's experience are desirable.

BRIEF SUMMARY

Articles of footwear with a ribbed outsole and a notched midsole are disclosed. In some embodiments, a sole for an article of footwear includes an outsole that has longitudinal ribs and a midsole that is disposed above the outsole and that defines notches. In some embodiments, the longitudinal ribs are disposed in the notches.

In some embodiments, the outsole has five longitudinal ribs. In some embodiments, the longitudinal ribs are disposed in a forefoot region of the sole. In some embodiments, the longitudinal ribs are disposed in a midfoot region of the sole. In some embodiments, the longitudinal ribs are disposed in a rearfoot region of the sole. In some embodiments, the longitudinal ribs have an equal length to each other. In some embodiments, at least one of the longitudinal ribs has a length different than another longitudinal rib.

In some embodiments, an article of footwear includes an upper, a midsole coupled to the upper that defines notches in its bottom surface, and an outsole coupled to the midsole that has longitudinal ribs extending from its top surface. In some embodiments, each longitudinal rib is disposed in one of the notches.

In some embodiments, the longitudinal ribs are disposed in a forefoot region of the article of footwear. In some embodiments, the longitudinal ribs are disposed only in a forefoot region of the article of footwear. In some embodiments, the top surface of the outsole is flat except for the longitudinal ribs.

In some embodiments, the notches are not interconnected. In some embodiments, a bottom surface of the outsole does not define any notches located opposite the longitudinal ribs. In some embodiments, a top surface of the midsole does not have any longitudinal ribs located opposite the notches.

In some embodiments, a sole for an article of footwear includes an outsole that has longitudinal ribs on its top surface and a midsole that defines notches that complementarily fit over the longitudinal ribs.

In some embodiments, the longitudinal ribs are disposed in a forefoot region of the sole. In some embodiments, the sole promotes a quicker transition to a forefoot of the sole during a gait cycle of a wearer. In some embodiments, the longitudinal ribs disposed in the notches stiffen the sole. In some embodiments, the outsole defines a pattern of holes extending through the outsole. In some embodiments, the holes are disposed in rows. In some embodiments, the rows of holes are disposed between the longitudinal ribs.

In some embodiments, a sole for an article of footwear includes an outsole and a midsole. In some embodiments, the outsole includes a first protrusion disposed in a forefoot lateral section of the outsole and a second protrusion disposed in a rearfoot medial section of the outsole. In some embodiments, the first and second protrusions each protrude on a top surface of the outsole. In some embodiments, the midsole is disposed above the outsole and defines a first notch disposed in a forefoot lateral section of the midsole and a second notch disposed in a rearfoot medial section of the midsole. In some embodiments, the first protrusion is disposed in the first notch and the second protrusion is disposed in the second notch.

In some embodiments, the first and second protrusions include a material that is the same as a material of the outsole. In some embodiments, the first and second protrusions are unitary portions of the outsole. In some embodiments, the first and second protrusions are rubber pods. In some embodiments, the first and second protrusions are separate components inserted into the outsole. In some embodiments, the first and second protrusions are longitudinal protrusions. In some embodiments, the first and second protrusions are curved. In some embodiments, the outsole defines a plurality of apertures. In some embodiments, the first and second protrusions are the only two protrusions on the top surface of the outsole. In some embodiments, the arrangement of the first and second protrusions and the first and second notches adds lateral stability to the sole in a forefoot lateral section and a rearfoot medial section of the sole.

In some embodiments, an article of footwear includes, an upper, a midsole coupled to the upper, and an outsole coupled to the midsole. In some embodiments, the midsole defines a first notch disposed in a forefoot lateral section of the midsole and a second notch disposed in a rearfoot medial section of the midsole. In some embodiments, the outsole includes a first protrusion disposed in a forefoot lateral section of the outsole and a second protrusion disposed in a rearfoot medial section of the outsole. In some embodiments, the first and second protrusions each protrude on a top surface of the outsole. In some embodiments, the first protrusion is disposed in the first notch and the second protrusion is disposed in the second notch.

In some embodiments, the first and second protrusions include a material that is the same as a material of the outsole. In some embodiments, the first and second protrusions are unitary portions of the outsole. In some embodiments, the first and second protrusions are rubber pods. In some embodiments, the first and second protrusions are separate components inserted into the outsole. In some embodiments, the first and second protrusions are longitudinal protrusions. In some embodiments, the first and second protrusions are curved. In some embodiments, the outsole defines a plurality of apertures. In some embodiments, the first and second protrusions are the only two protrusions on the top surface of the outsole. In some embodiments, the arrangement of the first and second protrusions and the first and second notches adds lateral stability to the sole in a forefoot lateral section and a rearfoot medial section of the sole.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION

Figure 1:
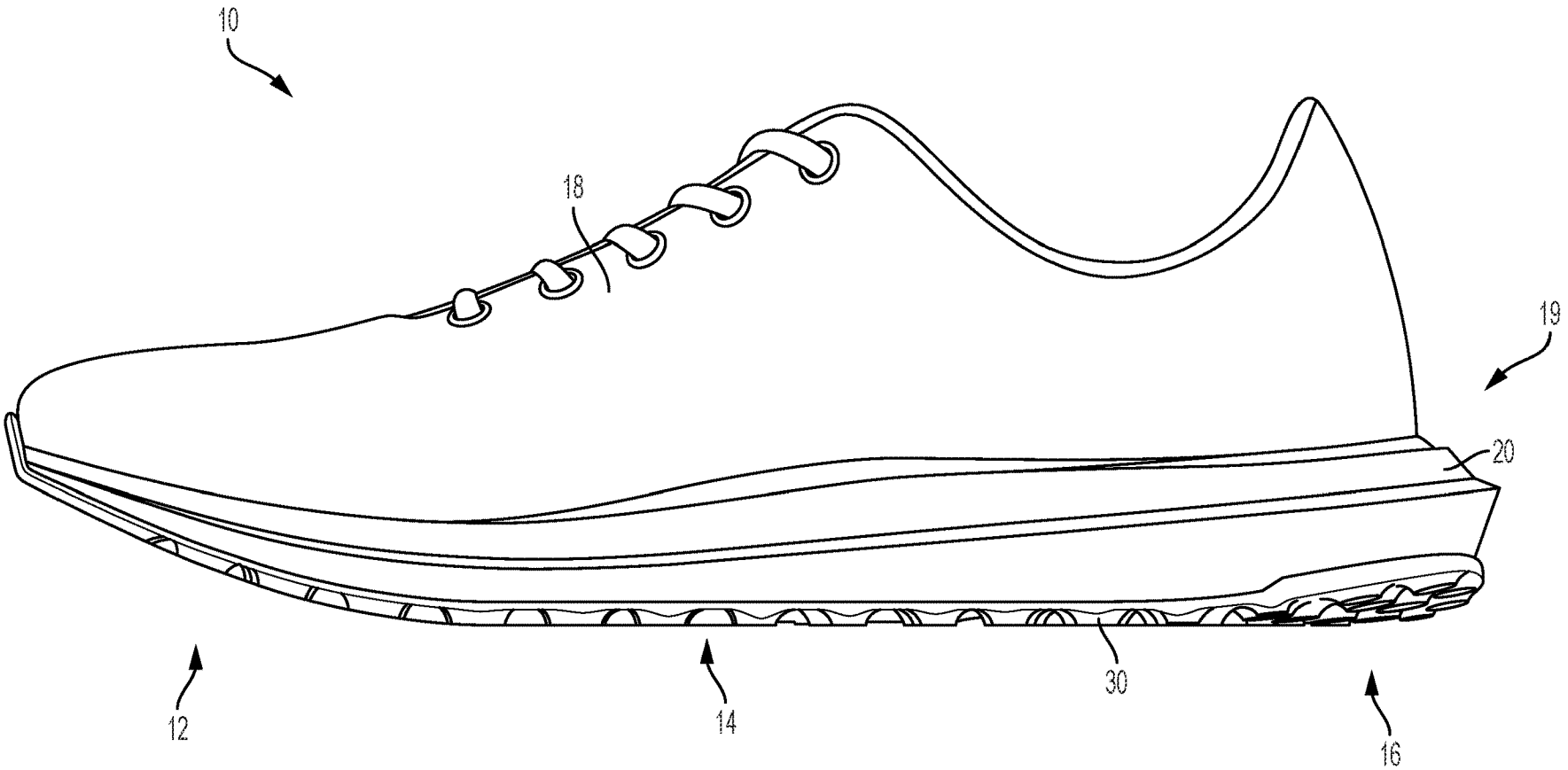
FIG. 1 shows a lateral side view of an article of footwear according to some embodiments.

The present invention will now be described in detail with reference to embodiments thereof as illustrated in the accompanying drawings, in which like reference numerals are used to indicate identical or functionally similar elements. References to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The term "invention" or "present invention" as used herein is a non-limiting term and is not intended to refer to any single embodiment of the particular invention but encompasses all possible embodiments as described in the application.

The following examples are illustrative, but not limiting, of the present invention. Other suitable modifications and adaptations of the variety of conditions and parameters normally encountered in the field, and which would be apparent to those skilled in the art, are within the spirit and scope of the invention.

Embodiments of the present invention provide articles of footwear having a ribbed outsole and a notched midsole. The ribbed outsole and notched midsole provide regulated flexion and stiffness in one or more regions of the foot. The outsole comprises a plurality of longitudinal ribs in one or more regions of the outsole. In some embodiments, the longitudinal ribs are disposed on a top surface of the outsole.

The midsole defines a plurality of notches that are configured to receive the longitudinal ribs. In some embodiments, the midsole is disposed above the outsole and the notches are disposed on a bottom surface of the midsole.

The interaction between the notches and the ribs may stiffen the sole (e.g., the outsole and/or the midsole) in the regions where the notches and ribs are located (e.g., in the mid to forefoot region under the metatarsal phalangeal joint (MTP) of the foot). In some embodiments, replacing midsole material volume with outsole material volume (i.e., adding ribs and notches) may stiffen the outsole. In some embodiments, the interaction between the notches and ribs may indirectly stiffen the midsole. The notches and ribs may also create a geometry that facilitates rocking (i.e., from back to front). Thus, the article of footwear may promote a quicker transition to the forefoot and thereby enhance the propulsive phase of a wearer's movement. Soles that use notches and ribs to provide the regulated flexion and stiffness are easy to create and manufacture and may also be easy to customize and/or adjust for a particular wearer.

In some embodiments, an article of footwear 10, as shown, for example, in FIG. 1, comprises a forefoot region 12, a midfoot region 14, and a rearfoot region 16. Article of footwear 10 may comprise an upper 18. Any suitable upper may be used as upper 18. Article of footwear 10 comprises a sole 19 that includes a midsole 20 and an outsole 30. In some embodiments, upper 18 is coupled to midsole 20. For example, upper 18 may be stitched, bonded, or adhered to midsole 20. In some embodiments, midsole 20 is coupled to outsole 30. For example, midsole 20 may be directly bonded to outsole 30. Alternatively, midsole 20 may be adhered to outsole 30 with an adhesive. In some embodiments, midsole 20 is made of expanded thermoplastic polyurethane particle foam (e-TPU).

Figure 2:
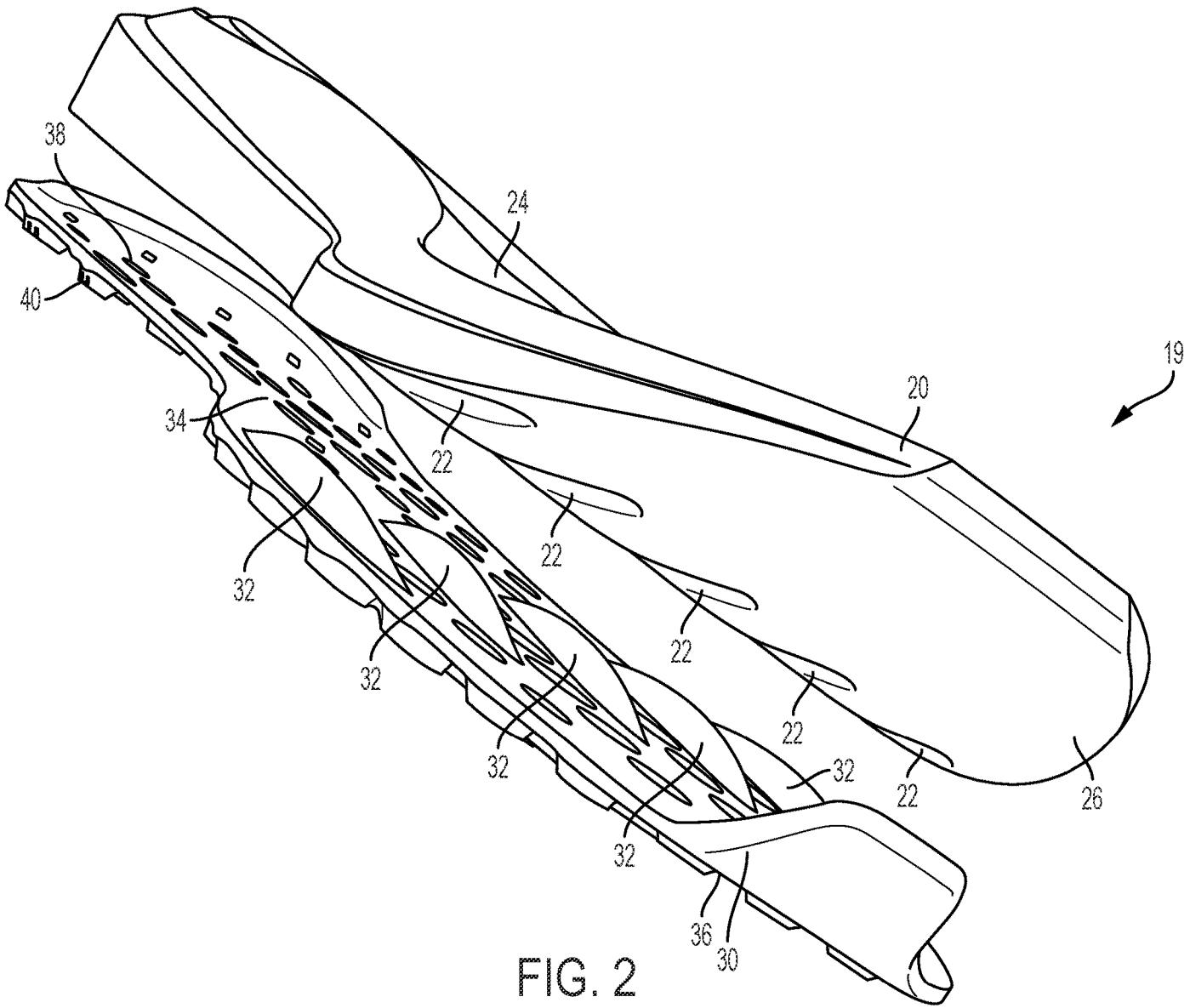
FIG. 2 shows an exploded perspective view of a sole for an article of footwear according to some embodiments.

In some embodiments, midsole 20 is disposed above outsole 30, as shown, for example, in FIG. 2. A top surface 34 of outsole 30 may correspond to a bottom surface 26 of midsole 20. For example, outsole 30 may include one or more structures that extend from top surface 34 and midsole 20 may define one or more voids in bottom surface 26 that correspond to the structures.

In some embodiments, outsole 30 comprises longitudinal ribs 32 that extend from top surface 34. Longitudinal ribs 32 extend in the longitudinal direction of article of footwear 10, such that the length of longitudinal ribs 32 is greater than the width of longitudinal ribs 32. In some embodiments, longitudinal ribs 32 have a varying height along their length (see FIG. 5). For example, a top surface of longitudinal ribs 32 may be curved with a greatest height of longitudinal ribs 32 at or near the center of the length of longitudinal ribs 32 and extending gradually down to top surface 34 of outsole 30 at the ends of longitudinal ribs 32. In some embodiments, a top surface of longitudinal ribs 32 may be domed. This configuration may contribute to the rocking function that promotes a quicker transition to the forefoot and thereby enhances the propulsive phase of a wearer's movement. For example, the curved geometry of longitudinal ribs 32 supports a quicker foot roll in a minimalistic way when longitudinal ribs 32 are located precisely under the MTP-joints, which is where the forefoot transition toward the propulsive toe-off occurs. In some embodiments, longitudinal ribs 32 have a higher hardness than midsole 20 (e.g., an e-TPU midsole), which together with the longitudinal ribs' 32 curvature may create "mini" rockers. The rockers naturally promote displacement from their unstable apex of the curve to a more neutral (at rest) position, thus helping a wearer to get to the toe-off phase. Other shapes and heights may also be used for longitudinal ribs 32.

Longitudinal ribs 32 may be disposed in a variety of locations on top surface 34 of outsole 30. In some embodiments, longitudinal ribs 32 are disposed in midfoot region 14. In some embodiments, longitudinal ribs 32 are disposed in forefoot region 12. Longitudinal ribs 32 may extend from midfoot region 14 to forefoot region 12. For example, longitudinal ribs 32 may be disposed under the metatarsal phalangeal joint (MTP) of the foot. In some embodiments, longitudinal ribs 32 are disposed only in forefoot region 12. In some embodiments, longitudinal ribs 32 are disposed separately in multiple regions. For example, a first set of longitudinal ribs 32 may be disposed in midfoot region 14 with a second set of longitudinal ribs 32 disposed in rearfoot region 16. Other configurations are also possible. For example, in some embodiments, outsole 30 may include diagonal ribs and/or transversal ribs. Such diagonal ribs and/or transversal ribs may be located in forefoot region 12, midfoot region 14, and/or rearfoot region 16. Diagonal ribs and/or transversal ribs may correspond to the notches shown in FIGS. 9 and 10, as discussed below. In some embodiments, longitudinal ribs 32 extend from rearfoot region 16 to forefoot region 12.

Figure 3:
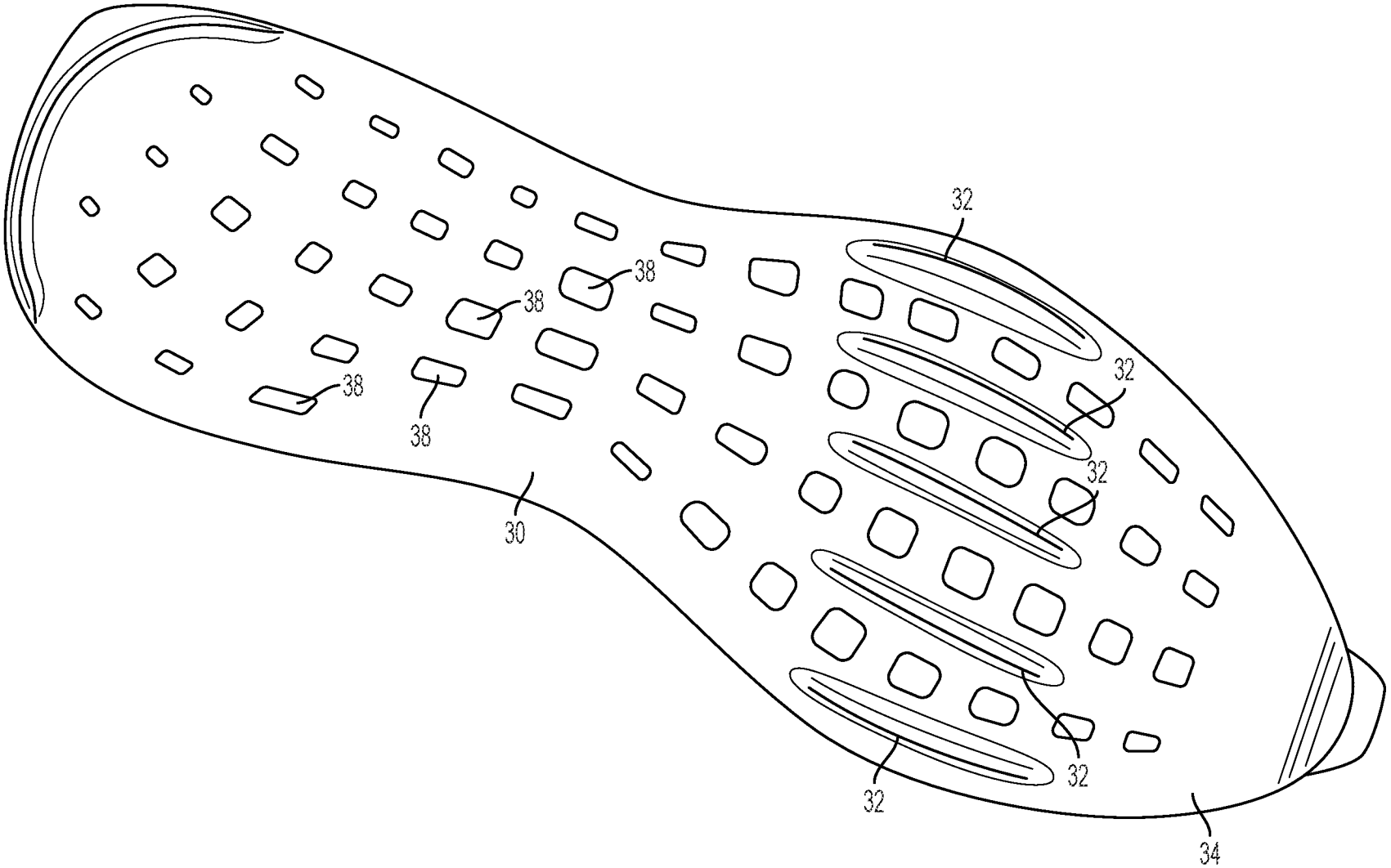
FIG. 3 shows a top view of an outsole for an article of footwear according to some embodiments.
Figure 4:
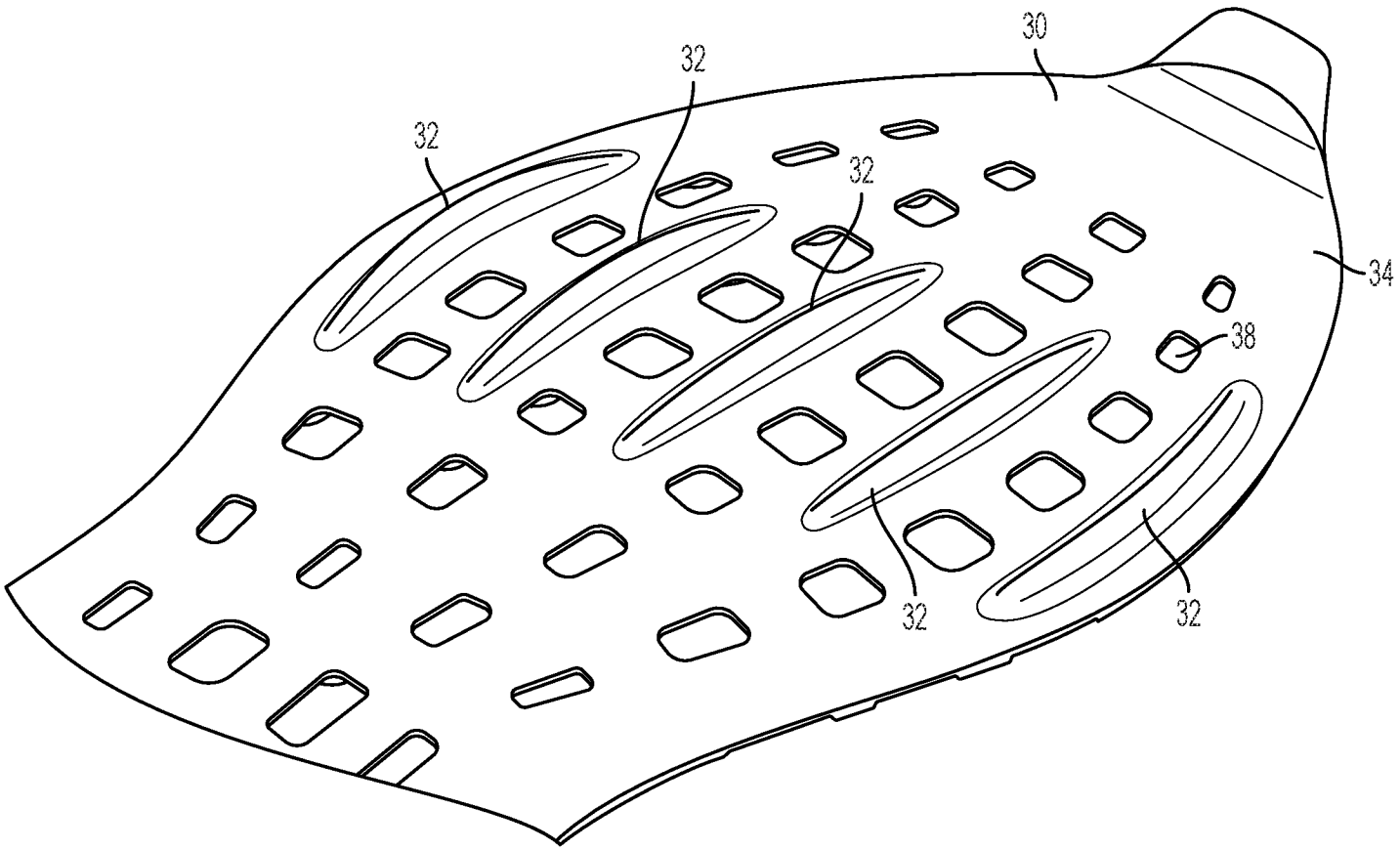
FIG. 4 shows a perspective view of a portion of an outsole for an article of footwear according to some embodiments.
Figure 5:
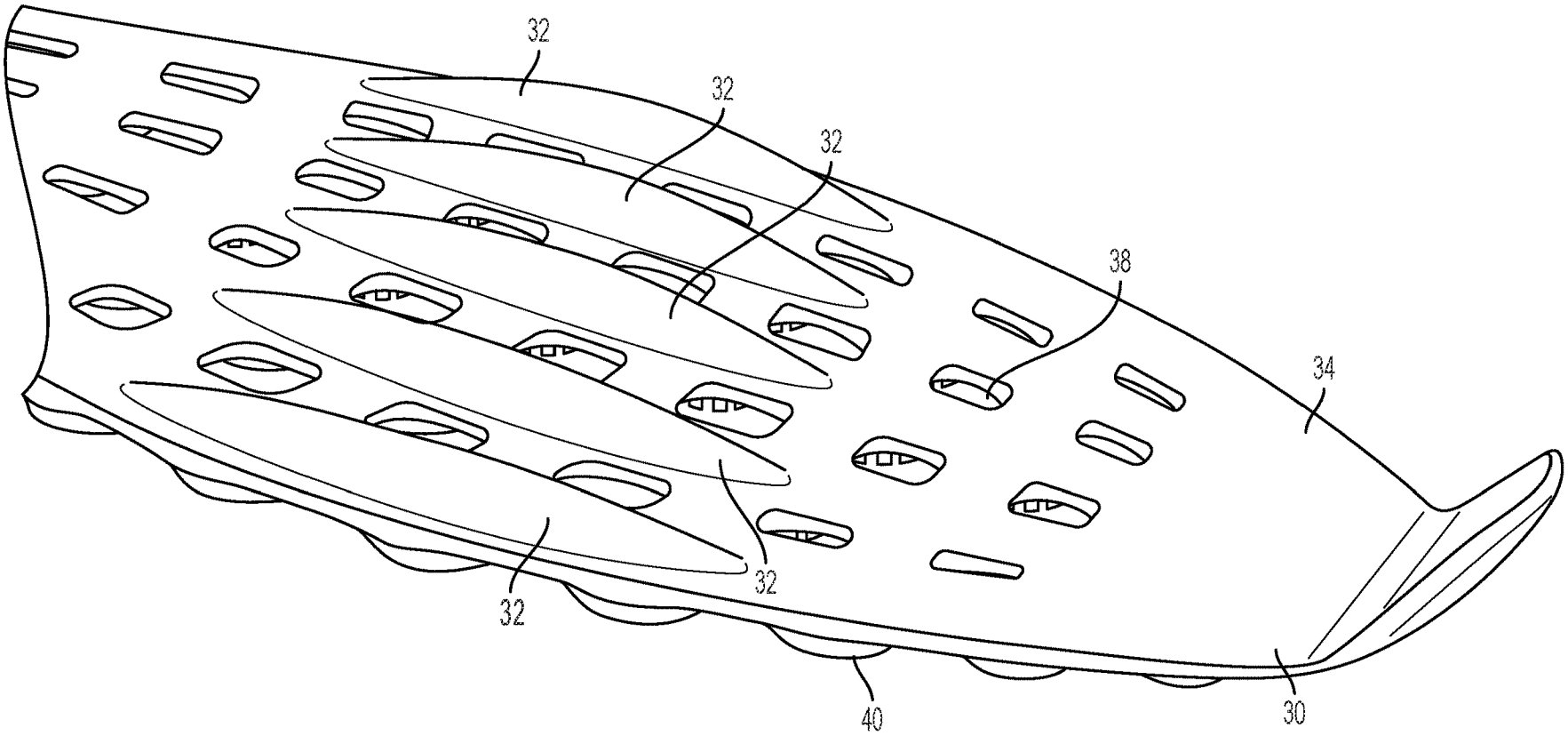
FIG. 5 shows a perspective view of a portion of an outsole for an article of footwear according to some embodiments.

In some embodiments, longitudinal ribs 32 are disposed parallel to each other. A set of longitudinal ribs 32 may be disposed spaced apart from each other across a width of outsole 30 (e.g., in the midfoot region 14 and/or forefoot region 12), as shown, for example, in FIG. 3. In some embodiments, outsole 30 includes at least three longitudinal ribs 32. For example, as shown in FIGS. 3-5, outsole 30 includes five longitudinal ribs 32. A different amount of longitudinal ribs 32 may be used (e.g., two, four, or more than five). In some embodiments, the dispersion of longitudinal ribs 32 across the width of forefoot region 12 help restrain the displacement of midsole 20 transversally during compression and loading. For example, longitudinal ribs 32 may compartment the bottom surface of midsole 20 into narrowed areas to limit transversal movement and displacement. In some embodiments, limiting some of the midsole transversal movements and displacements across the sole helps provide more foot stability during curvilinear running, sudden changes of direction (cuts), or hard lateral breaking.

In some embodiments, longitudinal ribs 32 each have the same length. Alternatively, longitudinal ribs 32 may have different lengths from each other. In some embodiments, the ends of longitudinal ribs 32 are aligned with each other along the longitudinal direction of article of footwear 10. In some embodiments, the ends of longitudinal ribs 32 may not be aligned (see FIG. 3).

In some embodiments, longitudinal ribs 32 are an integral, monolithic part of outsole 30. Thus, longitudinal ribs 32 may be integrally molded with outsole 30. Accordingly, ribbed outsole 30 is easy to manufacture.

In some embodiments, top surface 34 of outsole 30 is flat except for longitudinal ribs 32. For example, longitudinal ribs 32 are not interconnected (e.g., with transverse ribs or other projecting structures). In some embodiments, a bottom surface 36 of outsole 30 does not define any notches located opposite longitudinal ribs 32.

In some embodiments, outsole 30 defines a pattern of holes 38 extending through outsole 30, as shown, for example, in FIGS. 3-5. Holes 38 may be disposed in rows. For example, the rows of holes 38 may be disposed between longitudinal ribs 32. In some embodiments, holes 38 vary in size and shape. Holes 38 may, for example, be circular, square, rectangular, or oval.

Figure 6:
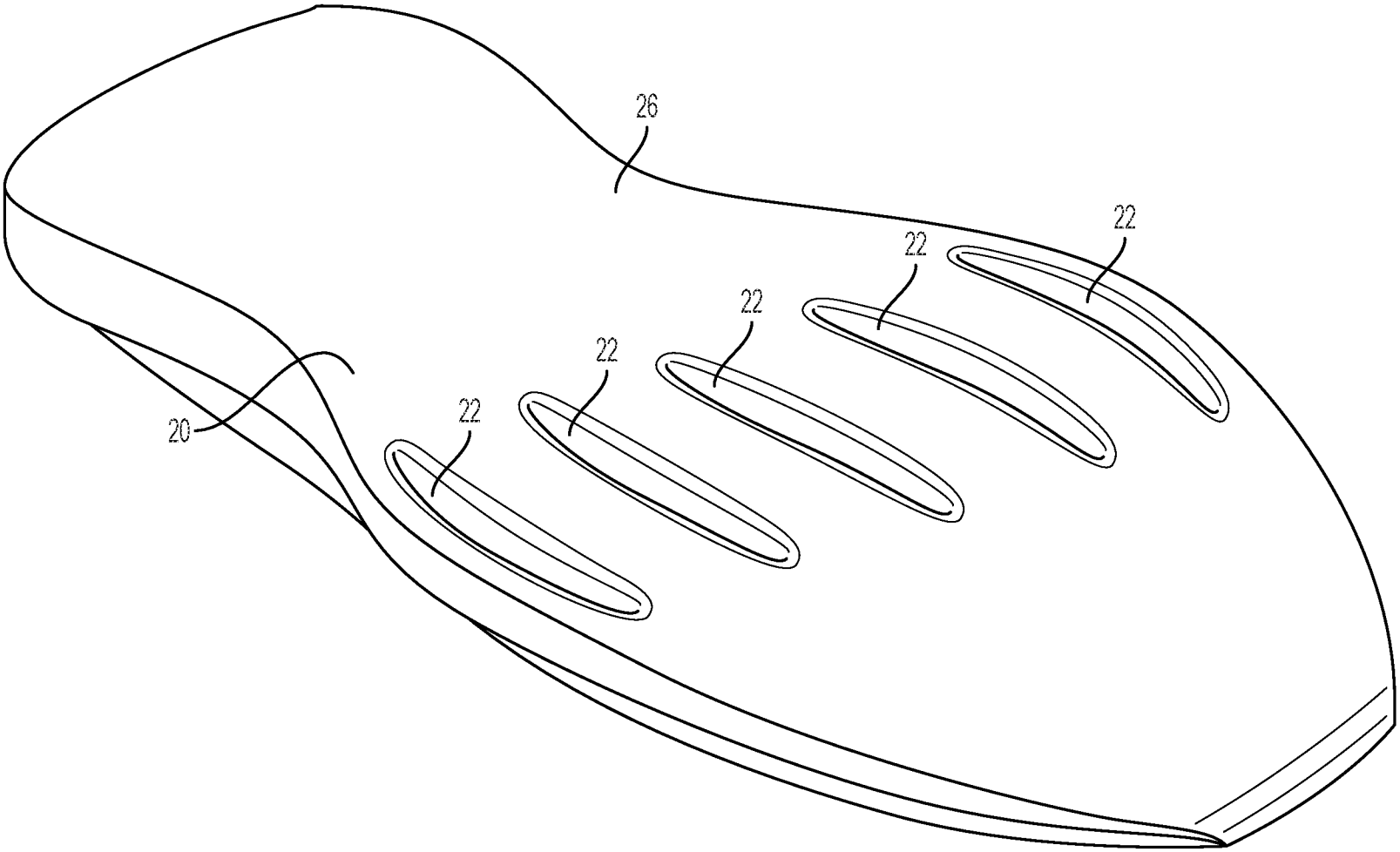
FIG. 6 shows a perspective view of a midsole for an article of footwear according to some embodiments.
Figure 7:
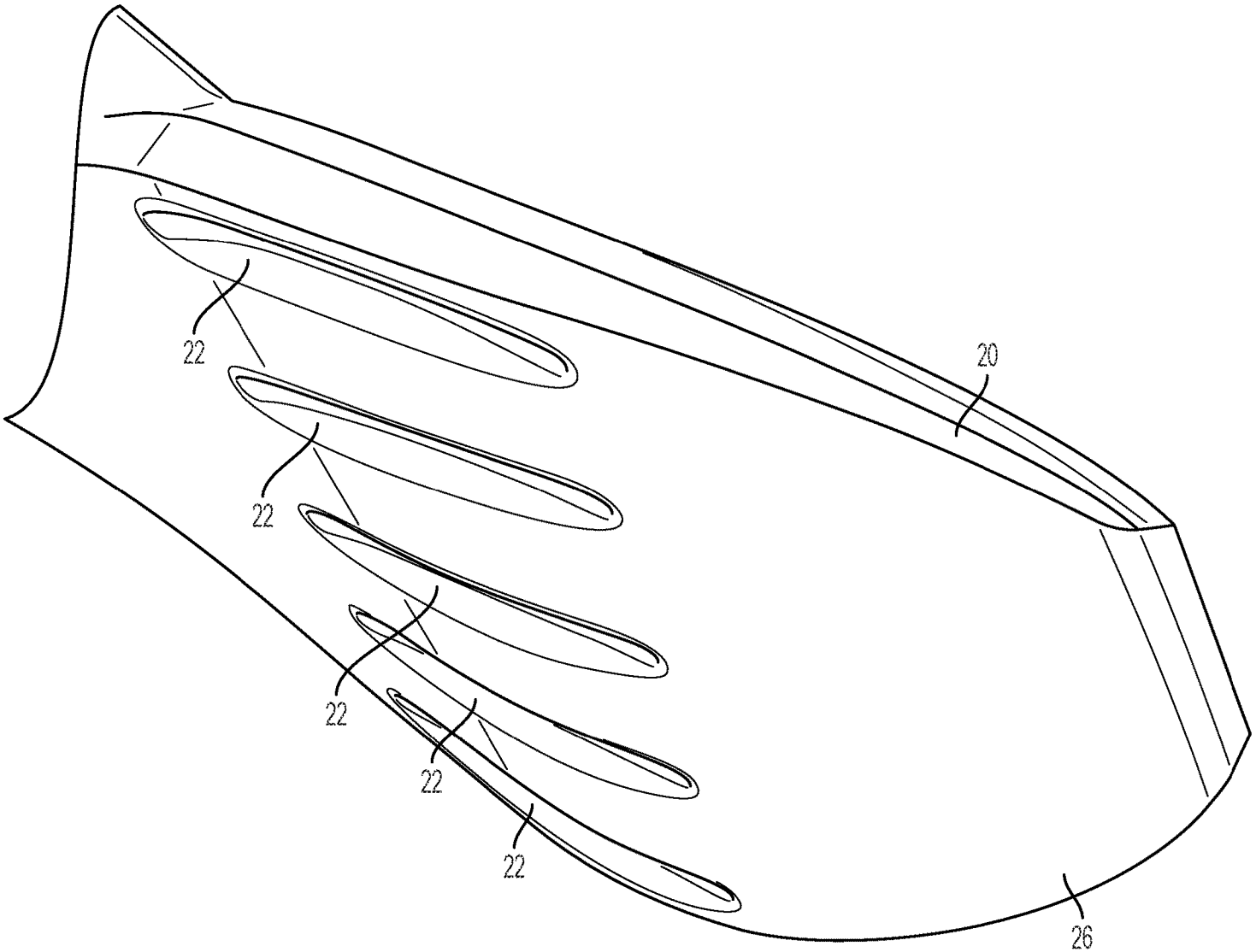
FIG. 7 shows a perspective view of a portion of a midsole for an article of footwear according to some embodiments.

In some embodiments, midsole 20 defines notches 22 in bottom surface 26 of midsole 20 that correspond to longitudinal ribs 32, as shown, for example, in FIGS. 2, 6, and 7. Notches 22 are configured to complementarily fit over longitudinal ribs 32. Thus, when article of footwear 10 is fully assembled (see FIG. 1), longitudinal ribs 32 are disposed within notches 22. In some embodiments, longitudinal ribs 32 completely fill notches 22. In some embodiments, longitudinal ribs 32 disposed in notches 22 stiffen the sole assembly (e.g., outsole 30 and/or midsole 20). In some embodiments, the interaction between notches 22 and ribs 32 may stiffen the entire sole assembly due to outsole 30 stiffening by adding ribs 32 and notches 22. In some embodiments, midsole 20 may be indirectly stiffened. When longitudinal ribs 32 are located under the MTP joint, the complementary notches 22 provide more stretch resistance in the longitudinal direction (of the wearer's gait) thus assisting the function of the foot ligaments in the metatarsal joints. With longitudinal ribs 32, the cushioning of midsole 20 may be soft and comfortable while outsole 30 stores and returns more energy during the propulsive phase of the gait (by resisting elongation) than it would without longitudinal ribs 32. By stiffening outsole 30, the wearer can thereby run faster. Sole 19 may be configured to promote a quicker transition to a forefoot during a gait cycle of the wearer.

In some embodiments, notches 22 extend in the longitudinal direction of article of footwear 10, such that the length of notches 22 is greater than the width of notches 22. In some embodiments, notches 22 have a varying depth along their length (see FIG. 7). For example, a surface of notches 22 may be curved with a greatest depth of notches 22 at or near the center of the length of notches 22 and extending gradually down to bottom surface 26 of midsole 20 at the ends of notches 22. This configuration may contribute to the rocking function that promotes a quicker transition to the forefoot and thereby enhances the propulsive phase of a wearer's movement. For example, the curved geometry supports a quicker foot roll, as discussed above with respect to longitudinal ribs 32. Other shapes and depths may also be used for notches 22.

Figure 9:
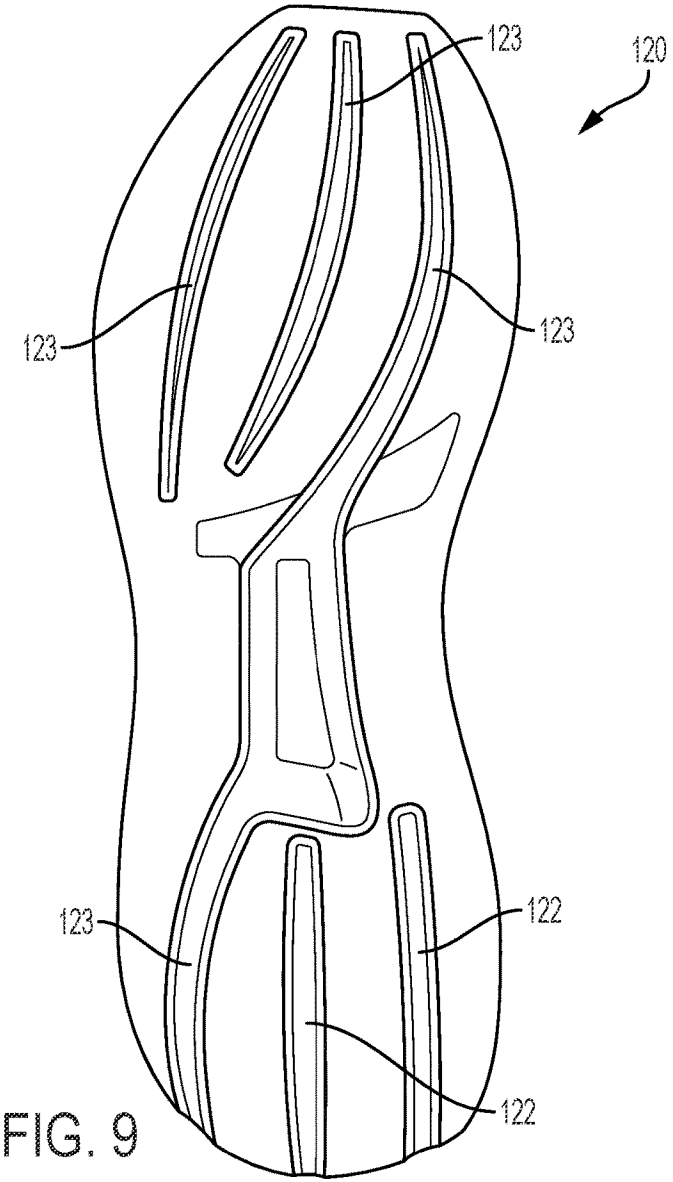
FIG. 9 shows a bottom view of a midsole for an article of footwear according to some embodiments.
Figure 10:
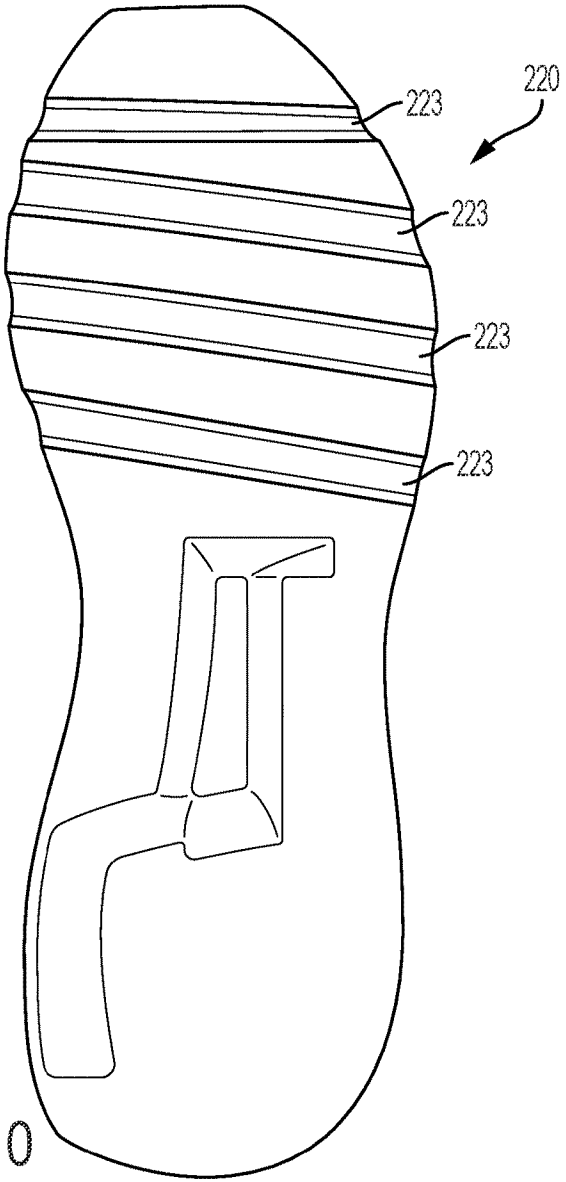
FIG. 10 shows a bottom view of a midsole for an article of footwear according to some embodiments.

Notches 22 may be disposed in a variety of locations on bottom surface 26 of midsole 20. In some embodiments, notches 22 are disposed in midfoot region 14. In some embodiments, notches 22 are disposed in forefoot region 12. Notches 22 may extend from midfoot region 14 to forefoot region 12. In some embodiments, notches 22 are disposed only in forefoot region 12. In some embodiments, notches 22 are disposed separately in multiple regions. For example, a first set of notches 22 may be disposed in midfoot region 14 with a second set of notches 22 disposed in rearfoot region 16. Other configurations are also possible. For example, in some embodiments, as shown in FIG. 9, a midsole 120 includes a combination of diagonal notches 123 and longitudinal notches 122. In some embodiments, diagonal notches 123 may be disposed in a forefoot region and/or a rearfoot region, as shown in FIG. 9. Diagonal notches 123 may also be disposed in a midfoot region. In some embodiments, longitudinal notches 122 may be disposed in a rearfoot region together with diagonal notches 123. In some embodiments, as shown, for example, in FIG. 10, a midsole 220 includes transversal notches 223. In some embodiments, transversal notches 223 are disposed in a forefoot region. Such transversal notches 223 may also or alternatively be located in a midfoot region and/or a rearfoot region. Any combination of diagonal notches 123, longitudinal notches 122, and transversal notches 223 may be disposed in a midsole, with corresponding ribs in an outsole. In some embodiments, notches 22 extend from rearfoot region 16 to forefoot region 12.

In some embodiments, notches 22 are disposed parallel to each other. A set of notches 22 may be disposed spaced apart from each other across a width of midsole 20 (e.g., in the midfoot region 14 and/or forefoot region 12), as shown, for example, in FIGS. 6 and 7. In some embodiments, midsole 20 includes at least three notches 22. For example, as shown in FIGS. 6 and 7, midsole 20 includes five notches 22. A different number of notches 22 may be used (e.g., two, four, or more than five).

In some embodiments, notches 22 each have the same length. Alternatively, notches 22 may have different lengths from each other. In some embodiments, the ends of notches 22 are aligned with each other along the longitudinal direction of article of footwear 10. In some embodiments, the ends of notches 22 may not be aligned.

In some embodiments, notches 22 are formed during a molding process of midsole 20, which facilitates easy manufacture of article of footwear 10.

In some embodiments, bottom surface 26 of midsole 20 is flat except for notches 22. For example, notches 22 are not interconnected (e.g., with transverse notches). In some embodiments, a top surface 24 of midsole 20 does not have longitudinal ribs located opposite notches 22.

Figure 8:
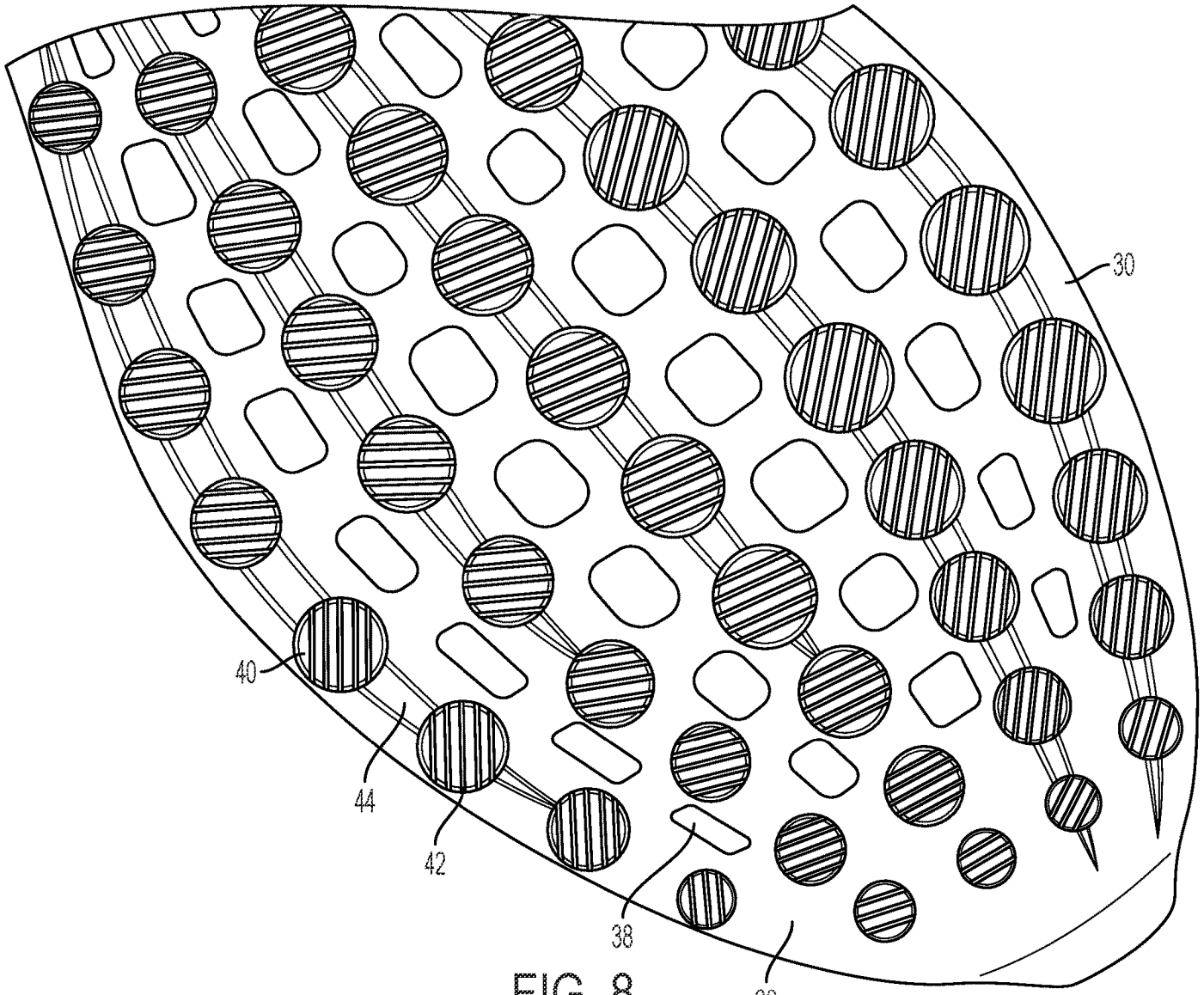
FIG. 8 shows a bottom view of a portion of an outsole for an article of footwear according to some embodiments.

In some embodiments, as shown, for example, in FIG. 8, outsole 30 comprises projections 40 extending from bottom surface 36. Projections 40 may be disposed in one or more rows. In some embodiments, rows of projections 40 are disposed between rows of holes 38. In some embodiments, projections 40 define a plurality of grooves 42 disposed on a ground-contacting surface of projections 40, which may provide increased traction for article of footwear 10. In some embodiments, projections 40 in each row are connected with connecting members 44 that extend from bottom surface 36 of outsole 30. In some embodiments, connecting members 44 contribute to stiffening the outsole by providing more stretch resistance in the longitudinal direction. In some embodiments, connecting members 44 help outsole 30 store and return more energy during the propulsive phase of the gait (by resisting elongation) than it would without connecting members 44. By stiffening outsole 30, the wearer can thereby run faster.

In some embodiments, article of footwear 10 is configured to help prevent over-lateralization (or spilling) of the cushioning in article of footwear 10, especially during multi-directional running. In some embodiments, a set of dynamic banking protrusions are included in a sole for article of footwear 10. The dynamic banking protrusions may provide additional lateral stability and support in the medial and lateral sections of the foot, thus counter-acting any tendency for over-lateralization or spilling during multi-directional running.

Figure 11:
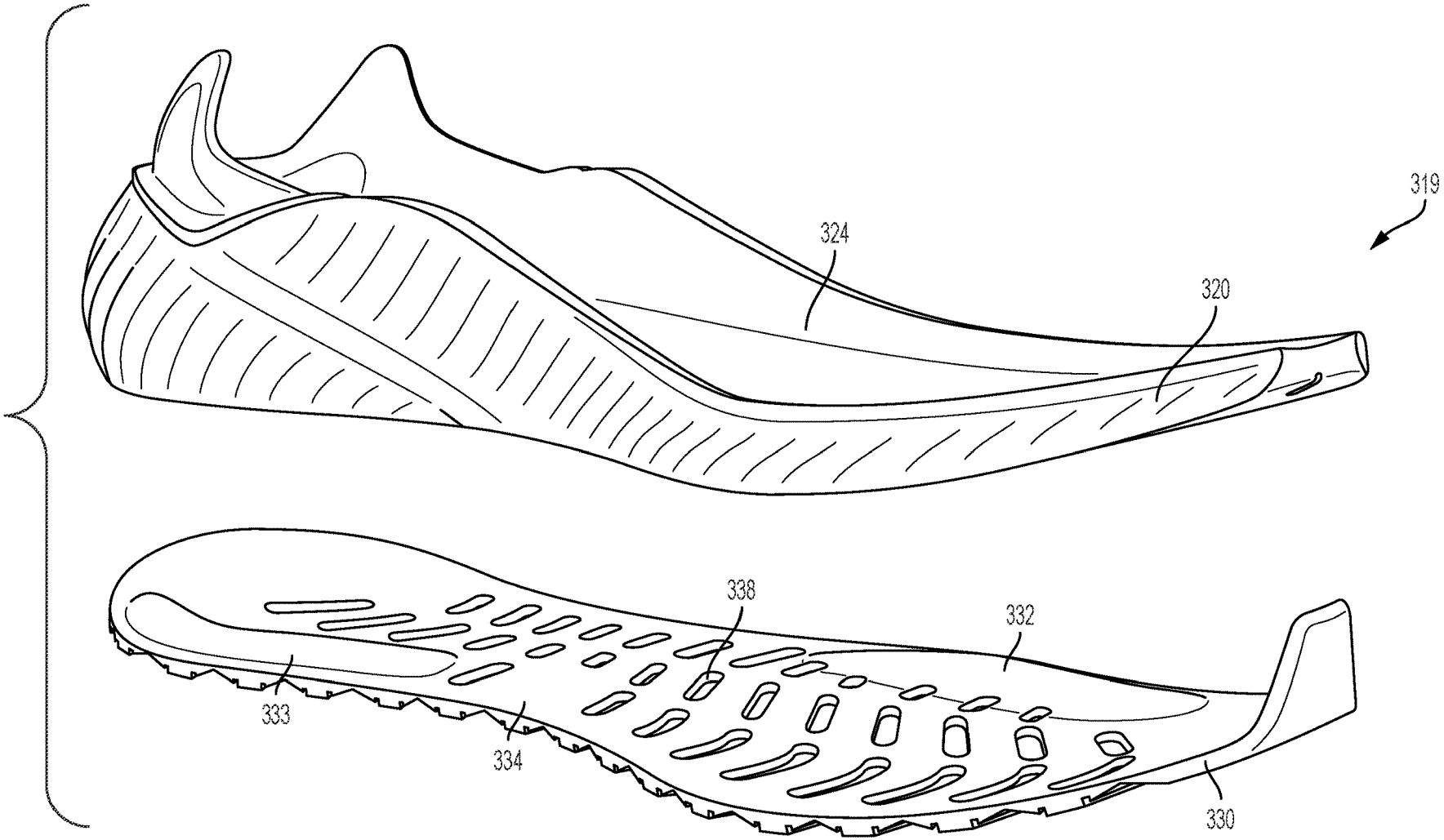
FIG. 11 shows an exploded perspective view of a sole for an article of footwear according to some embodiments.

For example, article of footwear 10 may include upper 18 (as shown in FIG. 1) coupled to a sole 319, as shown, for example, in FIG. 11. In some embodiments, sole 319 includes a midsole 320 and an outsole 330. Sole 319 (including midsole 320 and outsole 330) may include a forefoot region 312, a midfoot region 314, and a rearfoot region 316. Sole 319 (including midsole 320 and outsole 330) may include a lateral side 311 and a medial side 313. In some embodiments, sole 319 can be flat or partially curved.

In some embodiments, upper 18 is coupled to midsole 320. For example, upper 18 may be stitched, bonded, or adhered to midsole 320. In some embodiments, midsole 320 is coupled to outsole 330. For example, midsole 320 may be directly bonded to outsole 330. Alternatively, midsole 320 may be adhered to outsole 330 with an adhesive. In some embodiments, midsole 320 is made of expanded thermoplastic polyurethane particle foam (e-TPU).

In some embodiments, midsole 320 is disposed above outsole 330, as shown, for example, in FIG. 11. A top surface 334 of outsole 330 may correspond to a bottom surface 326 of midsole 320. For example, outsole 330 may include one or more structures that extend from top surface 334 and midsole 320 may define one or more voids in bottom surface 326 that correspond to the structures.

Figure 12:
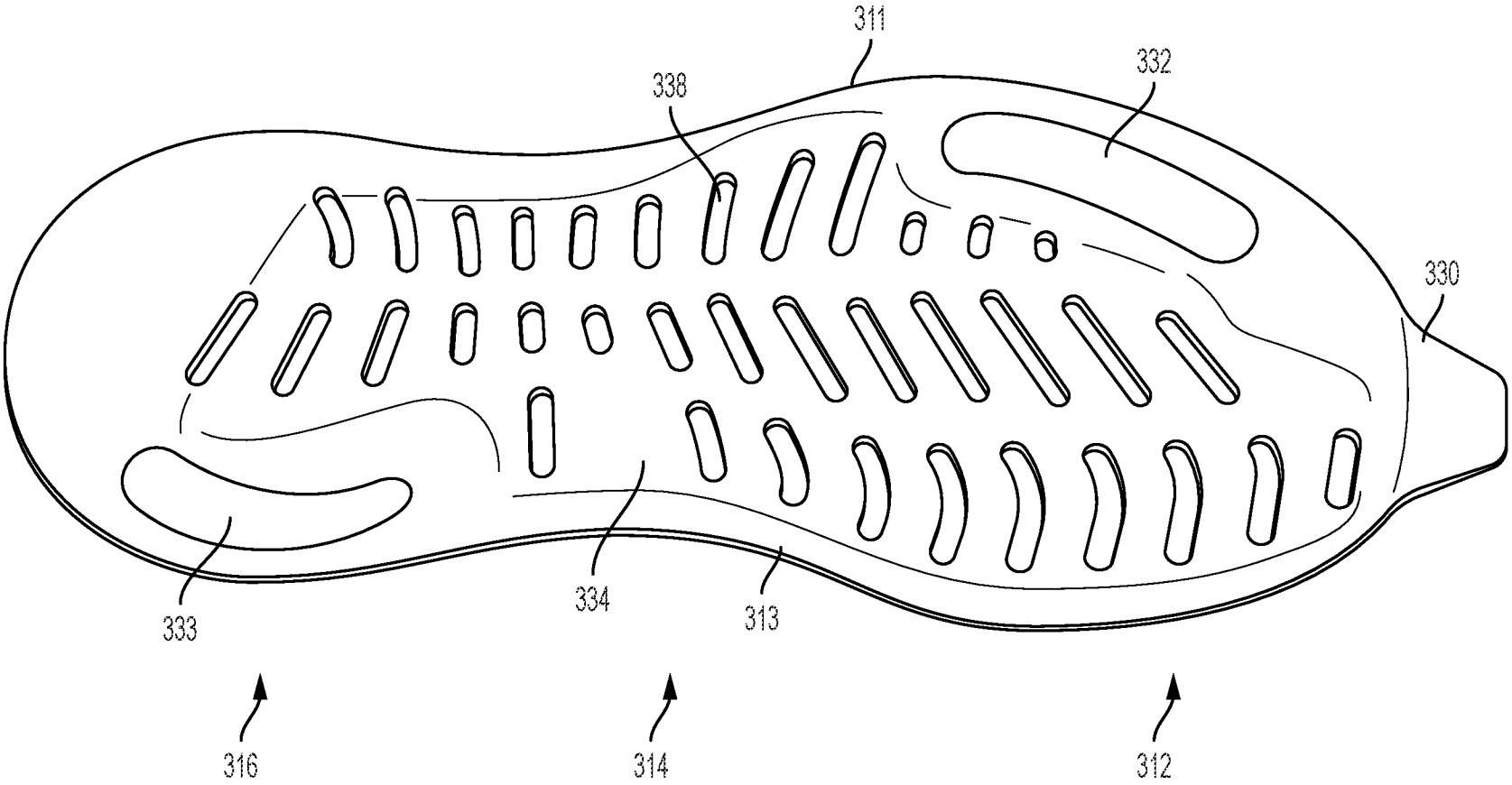
FIG. 12 shows a top view of an outsole for an article of footwear according to some embodiments.
Figure 13:
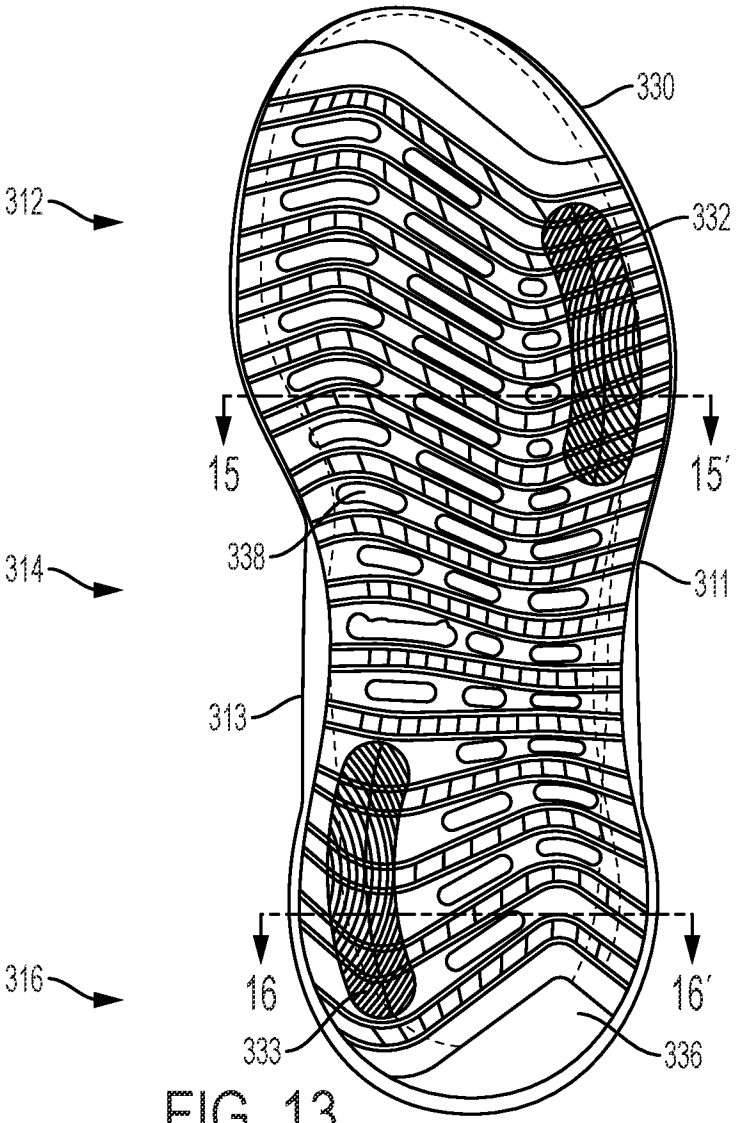
FIG. 13 shows a bottom view of a sole for an article of footwear according to some embodiments.

In some embodiments, outsole 330 comprises one or more protrusions, as shown, for example, in FIGS. 11-13. For example, outsole 330 may include a first protrusion 332 and a second protrusion 333. In some embodiments, first protrusion 332 and second protrusion 333 each protrude on top surface 334 of outsole 330 (see FIG. 11). In some embodiments, first protrusion 332 and second protrusion 333 provide additional lateral stability and support to sole 319. In some embodiments, first protrusion 332 and second protrusion 333 are dynamic banking protrusions configured to help the wearer avoid over-lateralization during multi-directional running by adding lateral stability.

In some embodiments, first protrusion 332 is disposed in a forefoot lateral section of outsole 330 (i.e., in forefoot region 312 on lateral side 311). This location of first protrusion 332 may help prevent over-lateralization or spilling, especially during multi-directional running. In some embodiments, first protrusion 332 may instead be disposed in a forefoot medial section (or an additional protrusion may be disposed in a forefoot medial section), which may help prevent the wearer from over-pronating during the gait cycle. In some embodiments, second protrusion 333 is disposed in a rearfoot medial section of outsole 330 (i.e., in rearfoot region 316 on medial side 313). This location of second protrusion 333 may help prevent over-lateralization during multi-directional running.

In some embodiments, first protrusion 332 and second protrusion 333 comprise a material that is the same as a material of outsole 330. In some embodiments, first protrusion 332 and second protrusion 333 are an integral, monolithic part of outsole 330. Thus, first protrusion 332 and second protrusion 333 may be unitary portions of outsole 330. For example, first protrusion 332 and second protrusion 333 may be integrally molded with outsole 330, which may make outsole 330 easy to manufacture.

In some embodiments, first protrusion 332 and second protrusion 333 comprise a material that is different than a material of outsole 330. In some embodiments, first protrusion 332 and second protrusion 333 are separate components inserted into outsole 330, whether or not the material of first protrusion 332 and second protrusion 333 are different than the material of outsole 330. In some embodiments, first protrusion 332 and second protrusion 333 are pods. For example, first protrusion 332 and second protrusion 333 may be rubber pods. Other materials may also be used for first protrusion 332 and second protrusion 333 (as pods or in other forms), such as polymer, polyurethane, thermoplastic polymer, thermoplastic polyurethane, silicone, foam, or similar materials. In some embodiments, first protrusion 332 may be different than second protrusion 333. For example, first protrusion 332 may be a different material than second protrusion 333. In some embodiments, first protrusion 332 may be a separate component made of rubber inserted into outsole 330 and second protrusion 333 may be integrally molded as a unitary portion of outsole 330. Other variations may also be used.

In some embodiments, first protrusion 332 and second protrusion 333 are longitudinal protrusions. For example, first protrusion 332 and second protrusion 333 may extend in the longitudinal direction of article of footwear 10, such that the length of first protrusion 332 and second protrusion 333 in the longitudinal direction is greater than the width of first protrusion 332 and second protrusion 333 in the transverse direction. In some embodiments, first protrusion 332 and/or second protrusion 333 are curved, as shown, for example, in FIG. 13. In some embodiments, the shape of first protrusion 332 and/or second protrusion 333 may follow the contours of the adjacent edges of outsole 330.

In some embodiments, first protrusion 332 and second protrusion 333 are the only two protrusions on top surface 334 of outsole 330. In some embodiments, top surface 334 of outsole 330 is flat except for first protrusion 332 and second protrusion 333. In some embodiments, a bottom surface 336 of outsole 330 does not define any notches located opposite first protrusion 332 and second protrusion 333. In some embodiments, first protrusion 332 and second protrusion 333 extend through outsole 330 so that first protrusion 332 and second protrusion 333 are visible at bottom surface 336 of outsole 330. First protrusion 332 and second protrusion 333 may be flush with bottom surface 336 of outsole 330 or first protrusion 332 and second protrusion 333 may extend below bottom surface 336.

In some embodiments, outsole 330 comprises a plurality of apertures 338 extending through outsole 330 (see FIGS. 11-13). In some embodiments, apertures 338 may be disposed in rows. In some embodiments, apertures 338 vary in size and shape. Apertures 338 may, for example, be circular, square, rectangular, oval, or some other shape.

Figure 14:
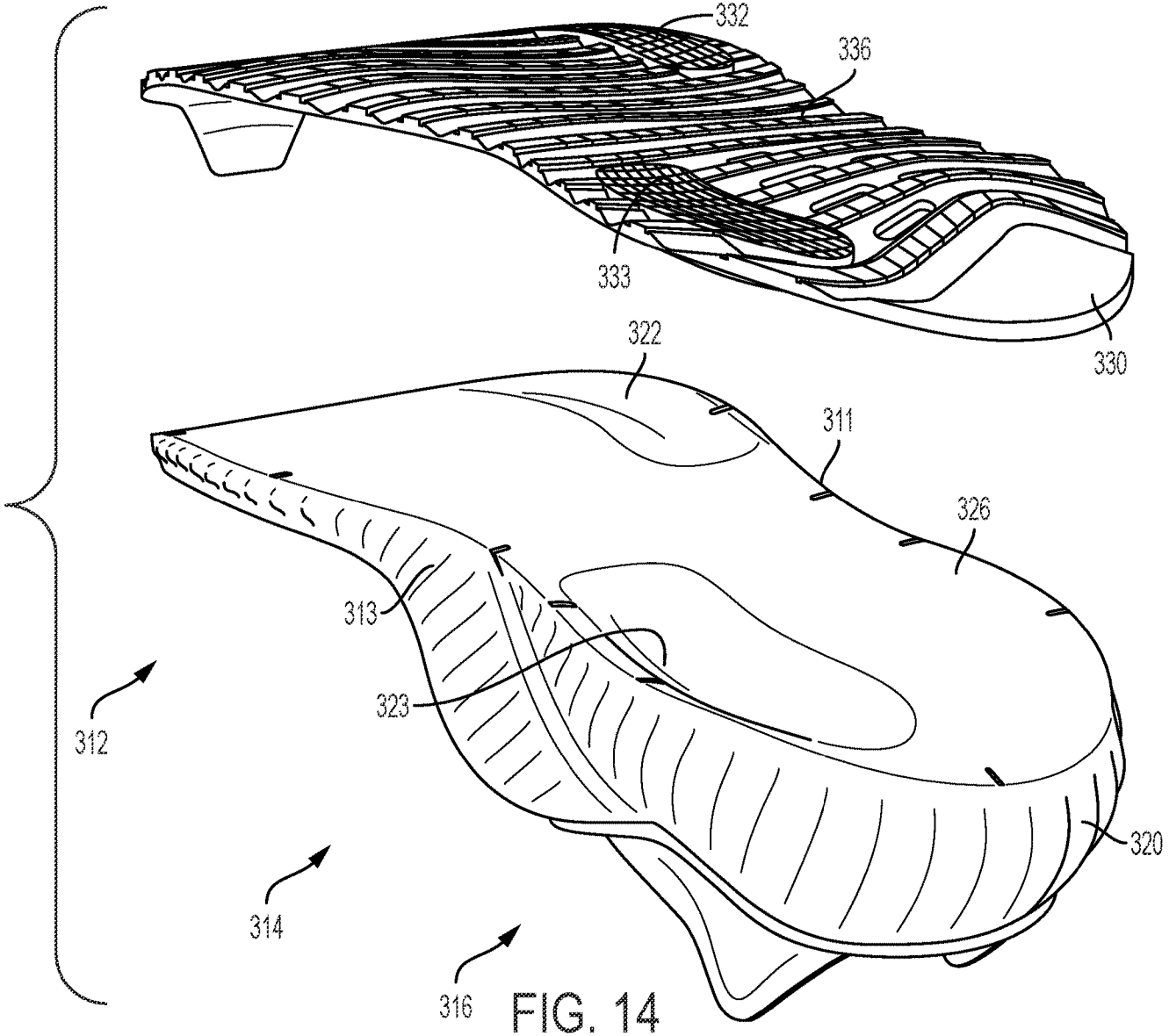
FIG. 14 shows an exploded perspective view of a sole for an article of footwear according to some embodiments.

In some embodiments, midsole 320 defines one or more notches, as shown, for example, in FIG. 14, that correspond to the one or more protrusions of outsole 330. The one or more notches are configured to complimentarily fit over the one or more protrusions. For example, midsole 320 may define a first notch 322 and a second notch 323. In some embodiments, first notch 322 is disposed in a forefoot lateral section of midsole 320 (i.e., in forefoot region 312 on lateral side 311). In some embodiments, second notch 323 is disposed in a rearfoot medial section of midsole 320 (i.e., in rearfoot region 316 on medial side 313). In some embodiments, the role of notches 322, 323 is to allow protrusions 222, 223 to fit-in (or fill-in, sit-in) and limit movement of midsole 320 in the area where they are located.

In some embodiments, bottom surface 326 of midsole 320 is flat except for first notch 322 and second notch 323. In some embodiments, a top surface 324 of midsole 320 does not have protrusions located opposite first notch 322 and second notch 323.

In some embodiments, first notch 322 and second notch 323 are formed during a molding process of midsole 320, which facilitates easy manufacture of article of footwear 10.

Figure 15:
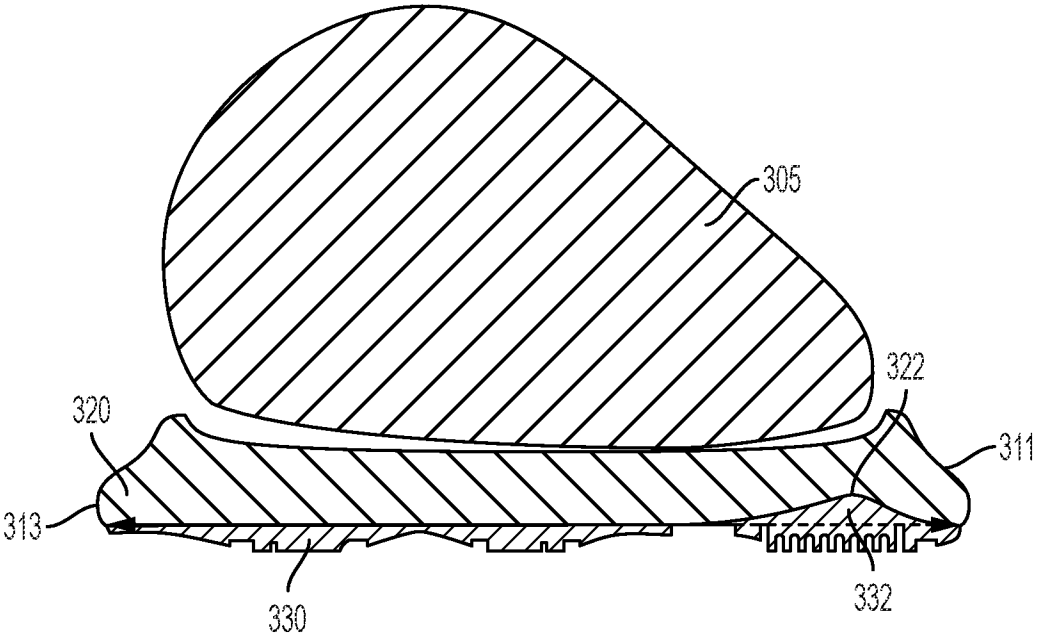
FIG. 15 shows a cross-sectional view of the sole of FIG. 13 taken along the line 15-15' in FIG. 13.
Figure 16:
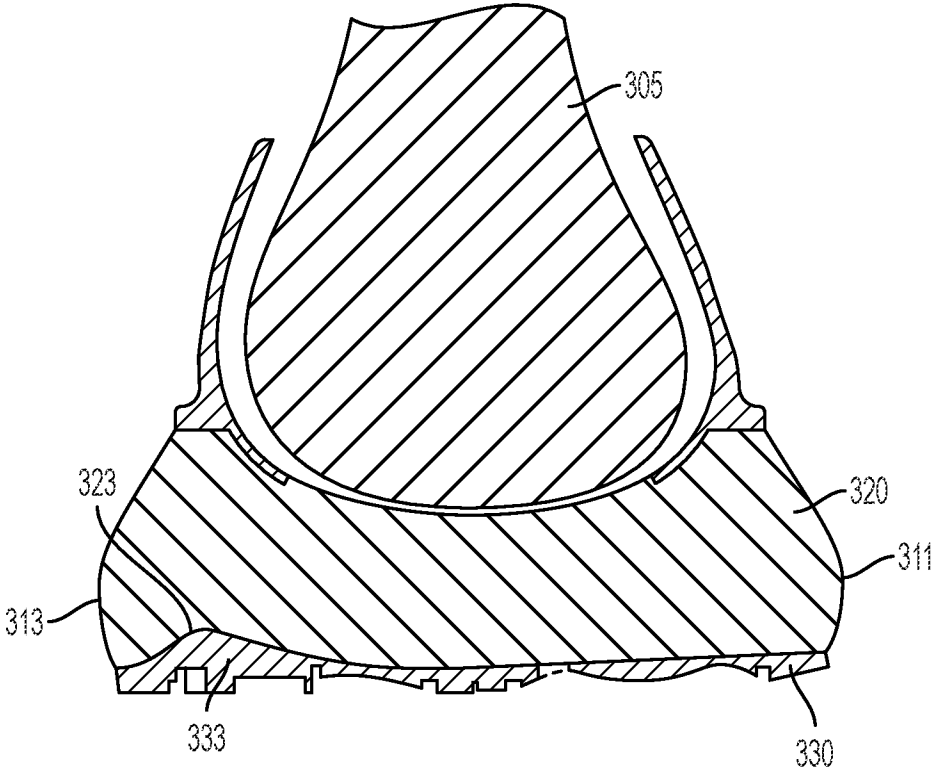
FIG. 16 shows a cross-sectional view of the sole of FIG. 13 taken along the line 16-16'.

In some embodiments, the one or more notches in midsole 320 correspond to the one or more protrusions in outsole 330. First protrusion 332 may be disposed in first notch 322, as shown, for example, in FIG. 15. In some embodiments, as shown for example in FIG. 15, the first protrusion 332 tapers in a lateral direction. Second protrusion 333 may be disposed in second notch 323, as shown, for example, in FIG. 16. In the some embodiments, as shown for example in FIG. 16, the second protrusion 333 tapers in the lateral direction. In some embodiments, first protrusion 332 and second protrusion 333 completely fill notch 322 and 323, respectively (see FIGS. 15 and 16). The arrangement of first protrusion 332 in first notch 322 may add lateral stability to the sole 319 in a forefoot lateral section of sole 319 (i.e., in forefoot region 312 on lateral side 311). The arrangement of second protrusion 333 in second notch 323 may add lateral stability to the sole 319 in a rearfoot medial section of sole 319 (i.e., in rearfoot region 316 on medial side 313). This additional lateral stability of sole 319 may help prevent the wearer from over-lateralization, especially during multi-directional running. The arrangement of sole 319 may help prevent the wearer's foot 305 from excessively rolling over while running in a curvilinear fashion, such as a sudden change of direction or lateral cuts. For example, the additional lateral stability caused by first protrusion 332 and first notch 322 help prevent the wearer's foot 305 from rolling beyond the location of first protrusion 332 and first notch 322. Similarly, the additional lateral stability caused by second protrusion 333 and second notch 323 help prevent the wearer's foot 305 from rolling beyond the location of second protrusion 333 and second notch 323.

Sole 319 may have similar features as sole 19, even if not expressly described. For example, protrusions of outsole 330 may have the same or similar characteristics as longitudinal ribs 32. As another example, notches of midsole 320 may have the same or similar characteristics as notches 22. In some embodiments, an outsole may include longitudinal ribs 32, first protrusion 332, and second protrusion 333. In some embodiments, a midsole may include notches 22, first notch 322, and second notch 323.

Various embodiments described herein provide an article of footwear with a ribbed outsole and notched midsole. The interaction between the notches and the ribs may stiffen the sole (e.g., outsole 30 and/or midsole 20) in the regions where the notches and ribs are located and create a geometry that facilitates rocking (i.e., from back to front). Thus, the article of footwear may promote a quicker transition to the forefoot and thereby enhance the propulsive phase of a wearer's movement. In addition, dispersing ribs across the width of the outsole may help restrain the displacement of the midsole transversally during compression and loading by compartmenting the midsole bottom surface in narrowed areas. Limiting some of the midsole transversal movements and displacements across the sole helps provide more foot stability during curvilinear running, sudden changes of direction (cuts), or hard lateral breaking. Soles that use notches and ribs to provide the regulated flexion and stiffness are easy to create and manufacture and may also be easy to customize and/or adjust for a particular wearer. Various embodiments described herein also provide an article of footwear with an outsole that includes dynamic banking protrusions and a midsole with corresponding notches. The protrusions and notches may add lateral stability to the sole and reduce over-lateralization, thus helping compensate a wearer when they suddenly change direction or move in a curvilinear fashion.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments but should be defined only in accordance with the following claims and their equivalents.

What is claimed is:

1. A sole for an article of footwear, the sole comprising:
an outsole comprising:
a first protrusion comprising a first material and extending from a top surface of the outsole,
a first protrusion aperture extending through the outsole from the top surface to a bottom surface of the outsole; and
a second material different from the first material of the first protrusion; and
a midsole disposed above the outsole and defining a first notch;
wherein the first protrusion is disposed in the first notch,
wherein the first protrusion is disposed within the first protrusion aperture, and
wherein the first material of the first protrusion is integrally molded with the second material of the outsole to form a monolithic part.

2. The article of footwear of claim 1, wherein the first protrusion is curved and follows a contour of an edge of the outsole.

3. The article of footwear of claim 1, wherein a plurality of apertures are formed through the outsole.

4. The article of footwear of claim 3, wherein the plurality of apertures are disposed in rows along the outsole.

5. The article of footwear of claim 1, wherein the outsole further comprises a second protrusion extending from the top surface of the outsole and disposed in a second notch formed in the midsole, and
wherein the second protrusion comprises the first material.

6. The article of footwear of claim 1, wherein the outsole further comprises a second protrusion extending from the top surface of the outsole and disposed in a second notch formed in the midsole, and
wherein the second protrusion comprises a third material different from the first and second materials.

7. The article of footwear of claim 1, wherein the outsole further comprises a second protrusion extending from the top surface of the outsole and disposed in a second notch formed in the midsole,
wherein the first protrusion is disposed in a forefoot region of the article of footwear and the second protrusion is disposed in a rearfoot region of the article of footwear.

8. The article of footwear of claim 7, wherein the first and second protrusions are the only two protrusions extending from the top surface of the outsole.

9. The article of footwear of claim 7, wherein the second protrusion is integrally molded with the outsole.

10. The article of footwear of claim 1, wherein the first and second materials are selected from the group consisting of: polyurethane, thermoplastic polymer, thermoplastic polyurethane, silicone, and foam.

11. The article of footwear of claim 1, wherein the bottom surface of the outsole is a ground-contacting surface of the outsole, and
wherein the first protrusion comprises a bottom surface defining a portion of the ground-contacting surface.

12. The article of footwear of claim 11, wherein a first groove pattern is formed in the bottom surface of the outsole, and a second groove pattern is formed in the bottom surface of the first protrusion, and
wherein the first groove pattern is different than the second groove pattern.

13. A sole for an article of footwear, the sole comprising:
an outsole comprising: a top surface, a bottom surface, and a first protrusion aperture extending through the outsole from the bottom surface to the top surface;
a midsole disposed above the outsole and defining a first notch;
a first protrusion disposed in the first protrusion aperture of the outsole and disposed in the first notch of the midsole; and
a second protrusion disposed in a second protrusion aperture extending through the outsole from the bottom surface to the top surface and disposed in a second notch formed in the midsole,
wherein the first and second protrusions are the only two protrusions disposed in protrusion apertures of the outsole and disposed in the notches of the midsole.

14. The article of footwear of claim 13, wherein the first protrusion is integrally molded with the outsole to form a monolithic part.

15. The article of footwear of claim 13, wherein the bottom surface of the outsole is a ground contacting surface of the outsole,
wherein a first groove pattern is formed in the bottom surface of the outsole,
wherein the first protrusion comprises a bottom surface defining a portion of the ground-contacting surface, and
wherein a second groove pattern different from the first groove pattern is formed in the bottom surface of the first protrusion.

16. The article of footwear of claim 13, wherein the outsole comprises a first material, and wherein the first protrusion comprises a second material different from the first material.

* * * * *